US009482486B2

(12) United States Patent
Kunkel

(10) Patent No.: US 9,482,486 B2
(45) Date of Patent: Nov. 1, 2016

(54) SOCK AND SLING SYSTEM

(71) Applicant: Martin James Kunkel, Newton, IA (US)

(72) Inventor: Martin James Kunkel, Newton, IA (US)

( * ) Notice: Subject to any disclaimer, the term of this patent is extended or adjusted under 35 U.S.C. 154(b) by 0 days.

(21) Appl. No.: 14/571,530

(22) Filed: Dec. 16, 2014

(65) Prior Publication Data

US 2016/0169618 A1 Jun. 16, 2016

(51) Int. Cl.
*F41C 33/00* (2006.01)

(52) U.S. Cl.
CPC ..... *F41C 33/002* (2013.01)

(58) Field of Classification Search
CPC .... Y10S 224/913; F41C 23/02; F41C 33/06; F41C 33/02; F41C 33/00; F41A 35/02; Y10T 24/12
USPC ..... 224/150
See application file for complete search history.

(56) References Cited

U.S. PATENT DOCUMENTS 4,756,456 A * 7/1988 Schauer ..... 224/150
2005/0118375 A1* 6/2005 Damiano ..... 428/36.1

* cited by examiner

*Primary Examiner* — Corey Skurdal
(74) *Attorney, Agent, or Firm* — Zarley Law Firm, P.L.C.

(57) ABSTRACT

A sock and sling system is presented for storing a gun within the sock in a storage state and for using as a sling connected to the gun when in a sling state. The system includes a sock extending a length from a first end to a second end and having an open interior. A pair of removable sling swivels connect the sock member to the gun. When used as a sling, the length of the sock member can be adjusted in a plurality of ways including twisting the sock member, selecting one of a number of loops to attach to or by adjusting the length of a length adjusting drawstring. In this way, a system is presented that serves the dual purpose of storing a gun in a storage state and as a sling in a sling state.

18 Claims, 5 Drawing Sheets

SOCK AND SLING SYSTEM

BACKGROUND OF THE INVENTION

This invention relates to a cases for guns. More specifically and without limitation, this invention is directed towards a particular type of gun case known as a gun sock.

Gun cases are old and well known in the art. Since the advent of guns, countless forms of gun cases have been developed which are used to house and protect guns during transportation and storage. In fact, many states require guns to be cased while being transported in vehicles.

One common type of gun case is known as a hard case. These cases are generally formed of a pair of hard or rigid halves that connect together at a hinge and open and close along a seam line between the two halves. These hard cases are generally filled with some form of a compressible material such as foam that protects and holds a gun when placed inside the hard gun case.

Hard gun cases provide superior protection for guns. Because of their rigid nature, these cases can be locked by adding a conventional lock to the case that holds the two halves together until the lock is removed. This feature allows gun owners to prevent unwanted persons, such as small children, from having access to the guns held within the case. For this reason, hard gun cases are required when guns are transported on airlines.

While hard gun cases provide many advantages, they have their deficiencies. Namely, hard gun cases, by their very nature, are not collapsible and therefore the space they take up is not diminished when the gun is removed from inside the case. This makes hard gun cases undesirable when space is a consideration.

Another common form of gun case is known as a gun sock. These cases are generally formed of an elongated piece of cloth material having an open end and a closed end with a cavity extending through its middle that houses the gun. To be compatible with the laws in many states, many gun socks have a drawstring that extends around the open end of the gun sock that is used to tie the open end closed or to tie the open end of the gun sock around a portion of the gun when positioned therein.

Unlike hard gun cases, gun socks are generally soft in nature. Gun socks provide the advantage of being extremely small and lightweight and therefore once removed from the gun they can be easily placed in a hunter's pocket or back pack once they reach the field. In addition, gun socks comply with the casing requirements of many states. Due to their lightweight, compressible and small nature, gun socks are very popular with many hunters.

One disadvantage of gun socks is that due to their soft and compressible nature, gun socks provide minimal protection to the gun when housed therein. Another disadvantage is to gun socks is that when the gun is removed from the gun sock, the gun sock has no utilitarian purpose once removed the gun sock is just an added piece of equipment that a hunter must carry with them in the field.

Many hunters and shooters also add slings to their guns. Conventionally, a sling is simply an elongated strap or piece of material that connects to the gun and forms a loop. When a gun is not in use, the loop of the sling is slung over the user's shoulder to help bear the weight of the gun during long treks. One disadvantage to conventional slings are that they are yet another piece of equipment that adds cost and weight. This is especially true a hunter or shooter is already carrying a gun sock, which is a similarly shaped elongated piece of material.

Therefore, a need exists in the art that combines the functionality of a gun sock with a gun sling.

Thus it is a primary objective of the invention to provide a sock and sling system that improves upon the state of the art.

Another object of the invention is to provide a sock and sling system that eliminates the redundancies of carrying both a sling and a gun sock.

Yet another object of the invention is to provide a sock and sling system that improves a user's hunting or shooting experience.

Another object of the invention is to provide a sock and sling system that eliminates unnecessary extra pieces of equipment.

Yet another object of the invention is to provide a sock and sling system that complies with casing laws.

Another object of the invention is to provide a sock and sling system that is easy to use.

Yet another object of the invention is to provide a sock and sling system that is convenient to use.

Another object of the invention is to provide a sock and sling system that is safe to use.

Yet another object of the invention is to provide a sock and sling system that is adjustable.

Another object of the invention is to provide a sock and sling system that has a simple design.

Yet another object of the invention is to provide a sock and sling system that saves money.

Another object of the invention is to provide a sock and sling system that is inexpensive.

Yet another object of the invention is to provide a sock and sling system that is comfortable to use.

Another object of the invention is to provide a sock and sling system that has an intuitive design.

Yet another object of the invention is to provide a sock and sling system that has a minimal number of parts.

Another object of the invention is to provide a sock and sling system that is durable.

Yet another object of the invention is to provide a sock and sling system that provides a long and useful life.

Another object of the invention is to provide a sock and sling system that provides dual functionality of casing and carrying a gun.

These and other objects, features, or advantages of the inventions will become apparent from the specification, drawings and claims.

SUMMARY OF THE INVENTION

A sock and sling system is presented for storing a gun within the sock in a storage state and for using as a sling connected to the gun when in a sling state. The system includes a sock extending a length from a first end to a second end and having an open interior. A pair of removable sling swivels connect the sock member to the gun. When used as a sling, the length of the sock member can be adjusted in a plurality of ways including twisting the sock member, selecting one of a number of loops to attach to or by adjusting the length of a length adjusting drawstring. In this way, a system is presented that serves the dual purpose of storing a gun in a storage state and as a sling in a sling state.

BRIEF DESCRIPTION FO THE DRAWINGS:

FIG. 1 is an exploded elevation view of a sock and sling system, the view shows a gun having a pair of mounting posts, a pair of sling swivels and a sock member having a drawstring that opens and closes an open end of the sock member thereby providing access to the open interior of the sock member, the view also showing a strap connected to the sock member and a shoulder pad connected to the sock member, the view also showing a length adjusting drawstring extending the entire length of the sock member and extending out of the sock member at its open end;

DETAILED DESCRIPTION OF THE PREFERRED EMBODIMENTS

Figure 1:
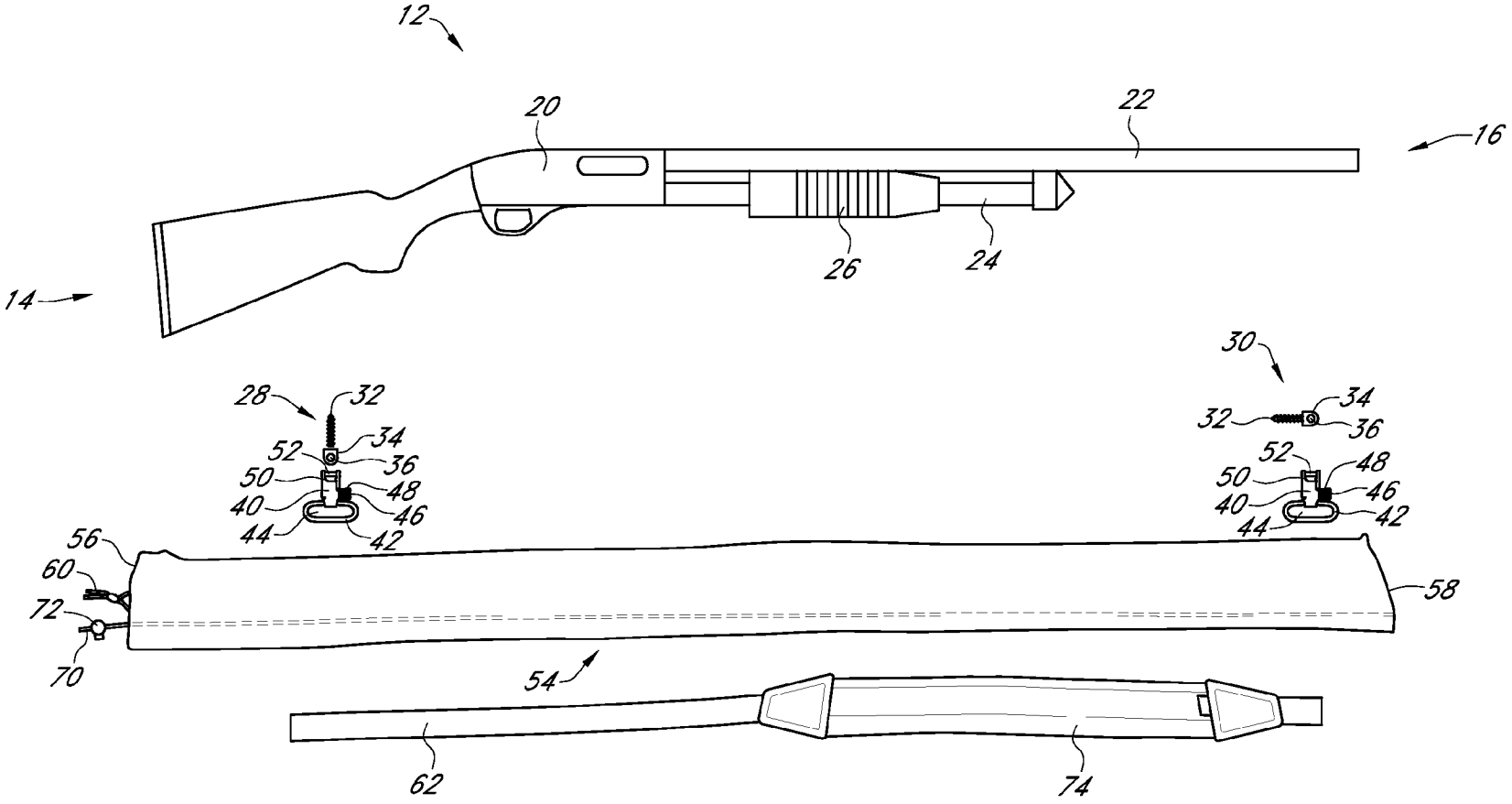
Figure 2:
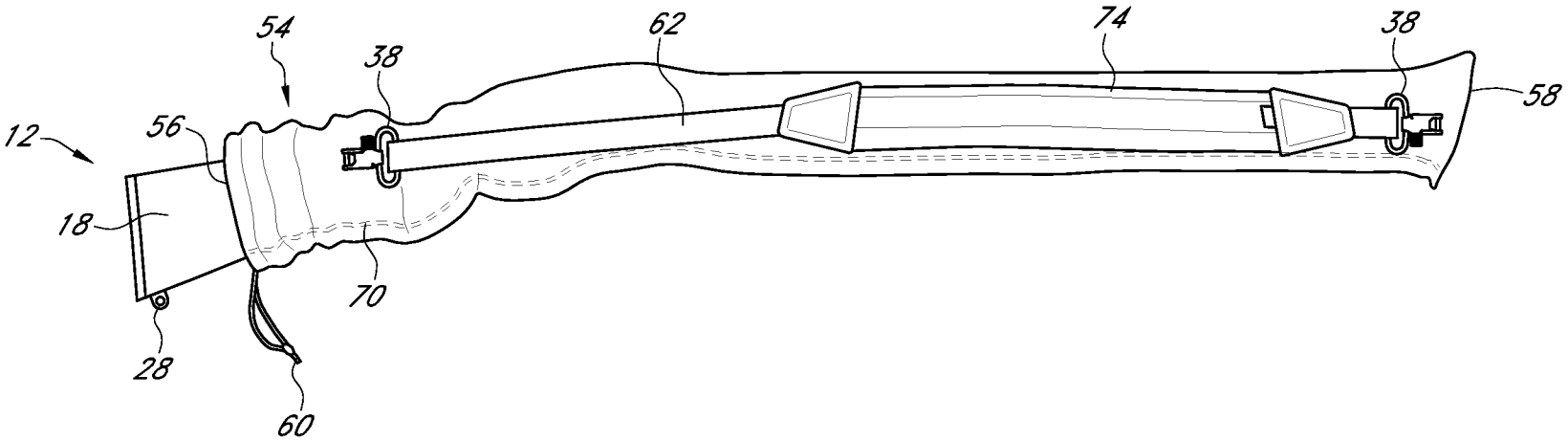
FIG. 2 is a is an elevation view of the sock member shown in FIG. 1 with the gun partially inserted in the open interior of the sock member, the view showing the sling swivels, strap and shoulder pad connected to the exterior surface of the sock member.
Figure 3:
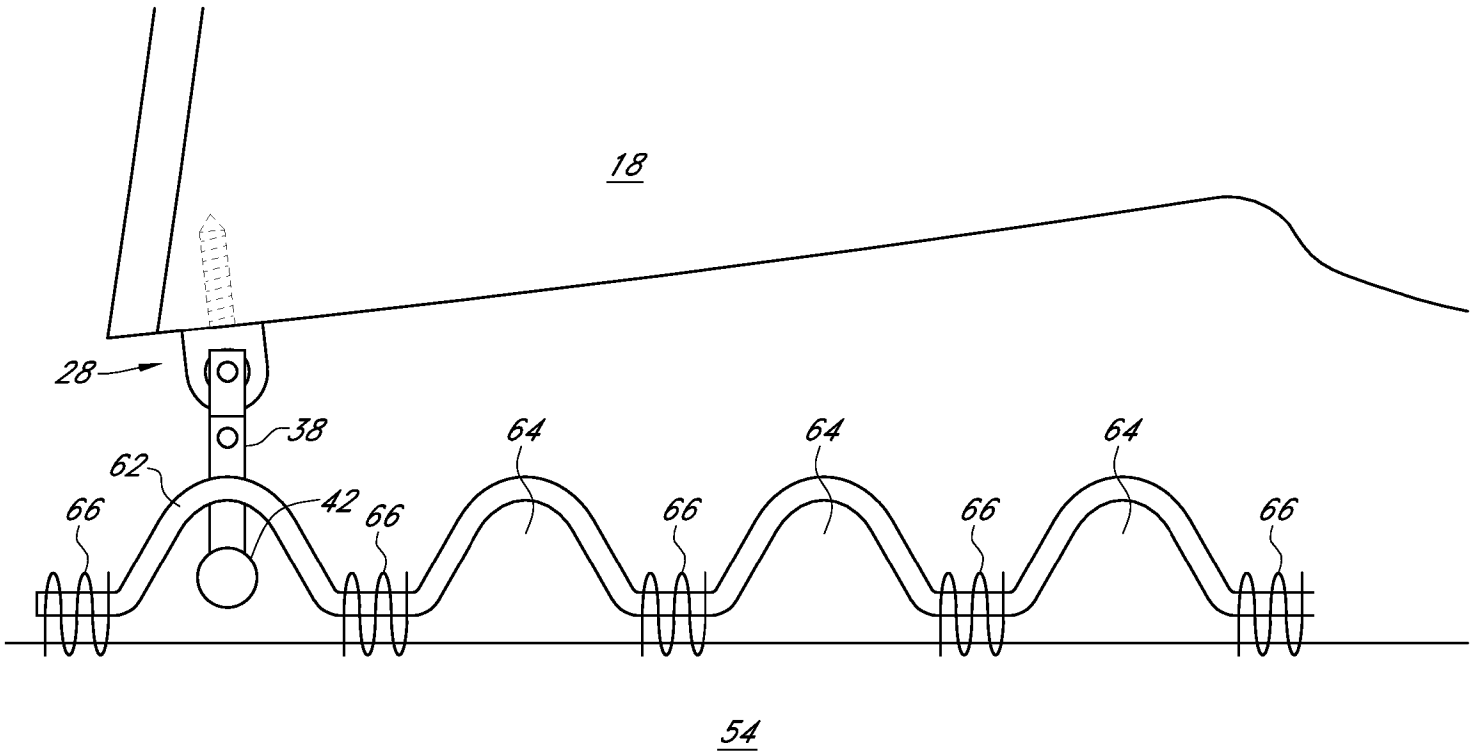
FIG. 3 is a is a close up side elevation view of the sock member, the view showing a plurality of loops formed by a strap, the strap sewn to the sock member on each side of the loops by stitching; the view also showing a sling swivel connected to one of the loops.
Figure 4:
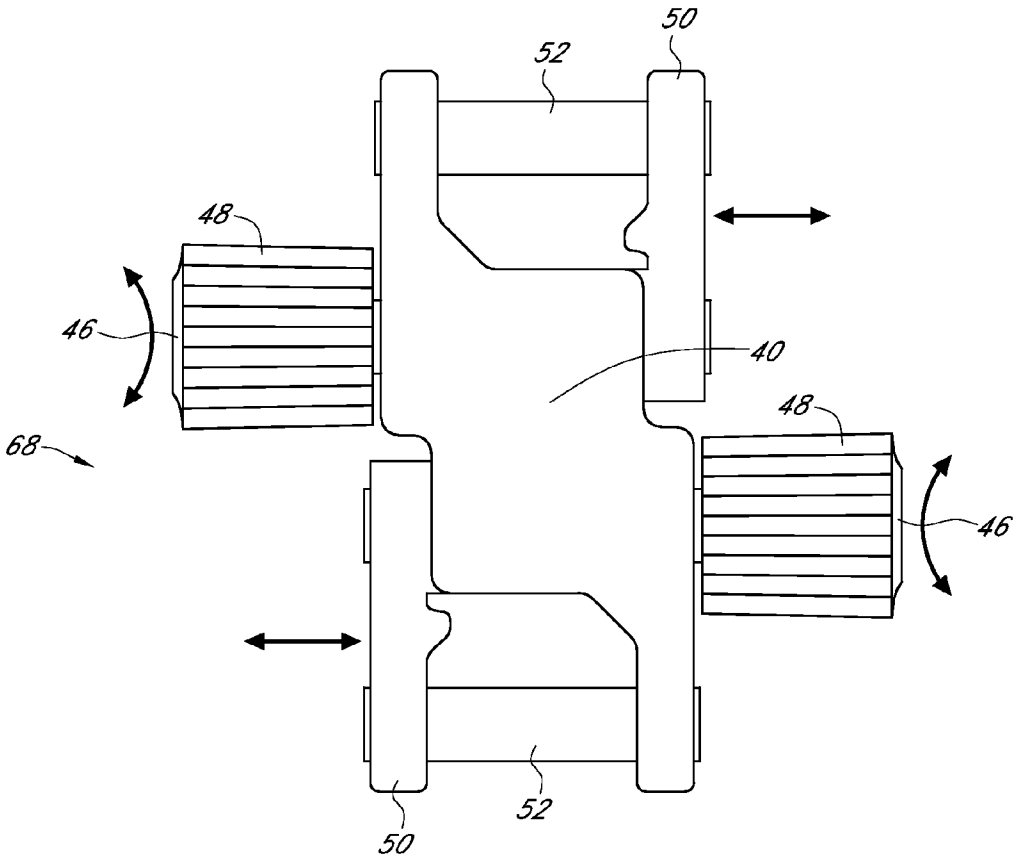
FIG. 4 is an elevation view of a dual release sling swivel having a main body and a pair of activation buttons connected to locking members that lock mounting rods.
Figure 5:
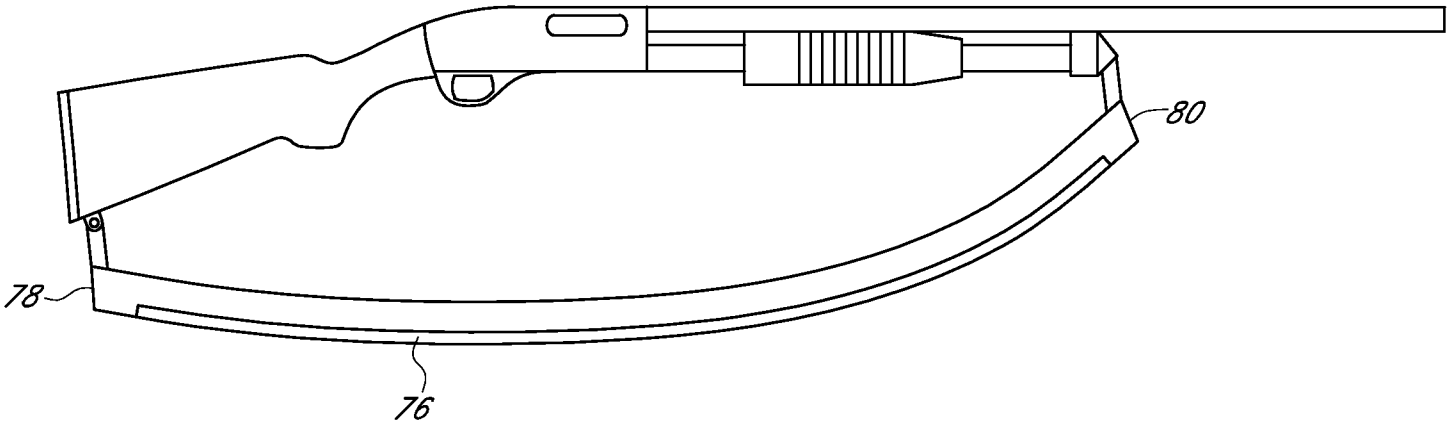
FIG. 5 is an elevation view of an alternative embodiment of a sock member having a zipper that extends a length between the forward and rearward ends of the sock member, the zipper providing access to the open interior of the sock member.

In the following detailed description, reference is made to the accompanying drawings which form a part hereof, and which is shown by way of illustration specific embodiments in which the invention may be practiced. These embodiments are described in sufficient detail to enable those skilled in the art to practice the invention, and it is to be understood that other embodiments may be utilized and that mechanical, procedural, and other changes may be made without departing from the spirit and scope of the invention. The following detailed description is, therefore, not to be taken in a limiting sense, and the scope of the invention is defined only by the appended claims, along with the full scope of equivalents to which such claims are entitled.

As used herein, the terminology such as vertical, horizontal, top, bottom, front, back, end, sides, and the like, are referenced according to the views presented. It should be understood, however, that the terms are used only for purposes of description, and are not intended to be used as limitations. Accordingly, orientation of an object or a combination of objects may change without departing from the scope of the invention.

With reference to the figures, a sock and sling system 10 is presented. The sock and sling system 10 is shown and described herein for use with a gun. However, the invention is not so limited. Reference to use with a gun is merely for purposes of an example and for convenience. It is hereby contemplated that the sock and sling system 10 may be used with any piece of equipment or mechanical device, especially equipment or mechanical devices that are carried by hand. As such, the sock and sling system 10 has applicability outside of guns and instead applies to any object, system or device.

In the arrangement shown, the sock and sling system is used in association with a gun 12. Again, the sock and sling system 10 is not limited to use with a gun 12, and reference to gun 12 is merely for convenience purposes. With that said, as used herein, the term gun is not to be limiting and refers to any form of a firearm such as shotguns, rifles, hand guns, muzzleloaders, and the like.

Gun 12 extends a lateral length from a rearward end 14 to a forward end 16. Gun 12 has a butt stock 18 adjacent its rearward end 14 that connects to an action 20 at the forward end of the butt stock 18. Action 20 connects at its rearward end to butt stock 18 and connects to a barrel 22 at its forward end. Barrel 22 connects at its rearward end to action 20 and extends forward before terminating at forward end 14. In the particular arrangement shown, gun 12 also includes a magazine tube 24 that is positioned below barrel 22 and connects at its rearward end to action 20. This magazine tube 24 also includes a pump mechanism 26 that fits over the magazine tube 24 and operatively connects with action 20 at its rearward end.

In one arrangement, as is shown, gun 12 includes a rear mounting post 28 that connects at or near the bottom rearward end 14 of butt stock 18. Similarly, in one arrangement, as is shown, gun 12 includes a forward mounting post 30 that connects to the forward end of magazine tube 24. In an alternative arrangement, rearward mounting post 28 and forward mounting post 30 can connect to gun 12 at any other place or in any other manner.

Rearward mounting post 28 and forward mounting post 30 are formed of any suitable size, shape and design. In the arrangement shown, rearward mounting post 28 and forward mounting post 30 have a threaded shaft 32 that connects to a bulbous head 34. The threaded shaft 32 is connected to gun 12 with the bulbous head 34 extending outwardly therefrom. Bulbous head 34 includes a through hole 36 that is used for mounting purposed as is described herein. However, again, any other form of a mounting member may be used.

Sling swivels 38 removably connect to rearward mounting post 28 and forward mounting post 30. Sling swivels 38 are formed of any suitable size, shape and design. In the arrangement shown, sling swivels 38 include a main body 40. A loop 42 connects to one end of the main body 40 and has an opening 44 therein that receives a strap, cord, or other sling member therein as is further describe herein.

Main body 40 also includes an activation button 46. Activation button 46 extends outwardly from one side of the main body 40 and includes a rotatable collar 48 that rotates between a locked position and an unlocked position. When in an unlocked position, activation button 46 is slidable towards main body 46 which causes locking member 50 to be decoupled from mounting rod 52 and the locking member 50 is rotatable away from mounting rod 52. In this decoupled state, mounting rod 55 is insertable into through hole 36 of either rearward mounting post 28 or forward mounting post 30. Once inserted, the activation button 46 is again depressed and the locking member 50 is rotated back over the end of mounting rod 52 and recoupled with the end of mounting rod 50 in a locked state. Once in this position, the rotatable collar is 48 is again rotated to a locked position thereby locking the mounting rod 52 over rearward mounting post 28 or forward mounting post 30.

System 10 also includes a sock member 54. Sock member 54 is formed of any suitable size, shape and design. In the arrangement shown, as one example, sock member 54 is formed of an elongated tubular piece of stretchable material that extends from an open end 56 to a closed end 58. A drawstring 60 extends around the open end 56 and is used to pull the open end 56 closed once gun 12 is inserted into the interior of sock member 54. Drawstring 60 is also used to tie the open end 56 of sock member 54 closed, and/or drawstring 60 is used to tie the open end 56 around a portion of gun 12 when gun 12 is inserted within sock member 54.

Sock Member Converts To Sling: In one arrangement, sling swivels 38 are mounted to the material of sock member 54. That is, one sling swivel 38 is mounted adjacent the closed end 58 of sock member 54 and one sling swivel 38 is mounted adjacent the open end 56 of sock member 54. In this arrangement, the rearward sling swivel is mounted to the rearward mounting post 28 and the forward sling swivel is mounted to the forward mounting post 30. This causes sock member 54 to form an opening or loop with gun 12 which allows sock member 54 to be used as a sling.

In use, the gun 12 is stored in the open interior of sock member 54. When the user or hunter arrives at their desired location the drawstring 60 adjacent the open end 56 of sock member 54 is untied and the gun 12 is removed from the open interior of sock member 54.

Next, the rotatable collar 48 of the one of the sling swivels 38 is rotated to an unlocked position and the activation button 46 is depressed. This causes the locking member 50 to decouple from the end of mounting rod 52. Once decoupled, locking member 50 is rotated out of the way of the end of mounting rod 52 and the mounting rod 52 is inserted into the through hole 36 of one of the mounting posts 28, 30 connected to gun 12.

Once mounting rod 52 is inserted into the through hole 36 of one of the mounting posts 28, 30, the activation button 46 is again depressed and the locking member 50 is rotated into place over the end of mounting rod 52. Once the locking member 50 is in place over the end of mounting rod 52 the activation button 46 is released and the locking member 50 again couples with the end of mounting rod 52 thereby holding the mounting post 28, 30 in place over mounting rod 52.

Once in this position, rotatable collar 48 is rotated into a locked position. This ensures that the locking member 50 does not become unintentionally decoupled from the mounting rod 52 during use.

This process is repeated for the other sling swivel 38 and mounting post 28, 30.

Once sock member 54 is connected to both mounting posts 28, 30, sock member 54 is used as a sling. That is, the sock member 54 can be hung over the user's shoulder which allows for easier and safer carrying of gun 12. Also, sock member 54 can be wrapped around the user's forward arm when aiming thereby improving the user's stability and aim.

In this way the sock member 54 is quickly and easily converted to use as a sling. This eliminates the need for a separate sling. This also reduces the amount of gear the user must carry with them.

To remove the sock member 54 and convert its use from a sling back to a sock, the user performs the opposite process and the sock member 54 is again used as a sock.

Sling Swivels Mounted To Sock Member: Sling swivels 38 are mounted to sock member 54 by any means or in any manner known in the art. In one arrangement, the sling swivels 38 are mounted directly to the material of sock member 54. In this arrangement, loops of material are formed directly into the material of the sock member 54 and a portion of the material of sock member 54 extends through opening 44 of loop 42 of sling swivels 38.

In another arrangement, one or more straps 62 are connected to the material of sock member 54. In this arrangement, straps 62 extends through opening 44 of loop 42 of sling swivels 38 and the strap 62 is attached to the exterior surface, or any other part, of sock member 54. In this arrangement, the strap 62 may be sewn, glued, adhered, affixed, welded or connected by any other manner or means. When strap 62 is affixed to sock member 54 on each side of sling swivel 38, a loop 64 is formed between the strap 62 and sock member 54. Sling swivel 38 then connects to this loop 64. In one arrangement, as is shown, stitching 66 is used to sew strap 62 to sock member 54 on either side of loop 64.

In one arrangement, a single strap 62 is affixed to sock member 54 and extends a length of the sock member 54 between pen end 56 and closed end 58. In this arrangement, the single strap 62 includes one or more loops 64 adjacent its forward end that connects to a first sling swivel 38, and one or more loops 64 adjacent its rearward end that connects to a second sling swivel 38.

In an alternative arrangement, two shorter portions of strap 62 are connected to the sock member 54, one adjacent its forward end that connects to a first sling swivel 38, and one adjacent its rearward end that connects to a second sling swivel 38. By adding these smaller strap portions 62 at or near the sight of the sling swivels 38 this provides reinforcement to the sock material 54 and tends to provide a more robust and durable connection site for the sling swivels 38 as compared to merely connecting the sling swivels 38 directly to the sock material 54 itself.

Because the material of sock member 54 itself tends to be stretchable, by affixing a single strap 62 that extends a length of the sock member 54 this tends to provide additional rigidity to the sock member 54 when it is used as a sling. This prevents the sock member 54 from over-stretching when used as a sling.

Adjustment: The length of the sock member 54 is important to ensure that it is long enough to hold the gun 12 and that it is the proper length for use as a sling.

In one arrangement, to adjust the length of the sock member 54 when used as a sling, one end of the sock member 54 is connected to the gun 12 and the sock member 54 is twisted one or more times before connecting the opposite end of the sock member 54 to the gun 12. This twisting shortens the length of the sock member 54 and quickly and easily allows the user to adjust the length of the sock member when used as a sling. The more the sock member is twisted the shorter the sling is. This twisting also thickens the material of the sock member 54 which can provide added comfort to a user when thicker material is slung over their shoulder.

In another arrangement, to allow for adjustment of the length of the sock member 54 when it is used as a sling, strap 62 is sewn to the material of sock member 54 in a plurality of places by stitching 66 to form a plurality of loops 64. This allows the user to select the appropriate loop 64 to provide the appropriate length of the sock member 54 when used as a sling.

In this arrangement, it may be desirable to have a dual release sling swivel 68. A dual release sling swivel 68 is much like the previously described sling swivel 38 with loop 42 being replaced by a second activation button 46, locking member 50 and mounting rod 52. That is, dual release sling swivel 68 includes a main body 40 positioned at its middle. Main body 40 also includes a pair of activation buttons 46. Activation buttons 46 extends outwardly from the main body 40 and include a rotatable collar 48 that rotates between a locked position and an unlocked position. When in an unlocked position, activation buttons 46 are slidable towards main body 46 which causes a locking member 50 on the opposite side of the main body to be decoupled from a mounting rod 52. Once the locking member 50 is decoupled from the mounting rod 52, the locking member 50 is rotatable away from mounting rod 52. In this decoupled state, mounting rod 52 is insertable into either a through hole 36 of either rearward mounting post 28 or forward mounting post 30 or through a loop 64 connected to the sock member 54. Once inserted, the activation button 46 is again depressed and the locking member 50 is rotated back over the end of mounting rod 52 and recoupled with the end of mounting rod 50 in a locked state. Once in this position, the rotatable collar is 48 is again rotated to a locked position thereby locking the mounting rod 52 over rearward mounting post 28 or forward mounting post 30.

In this way, the use of a dual release sling swivel 68 allows a user to select the loop 64 they desire to connect the dual release sling swivel 68. In addition, the use of a dual release sling swivel 68 allows the user to connect and disconnect to and from either or both of the gun 12 and the sock member. In this way, a user can decide if they want the dual release sling swivels 68 to stay attached to the gun 12 or to the sock member 54.

In another arrangement, to adjust the length of the sock member 54 when used as a sling, one or more draw strings 70 extends a portion of the length or the entire lateral length of the sock member 54. In one arrangement, an end of draw string 70 extends out of an end of the sock member 54 and includes a length adjusting device 72 connected thereto. Length adjusting device 72 is any devices that assists with adjustment of the length of draw string 70, or helps to hold the length of draw string 70 once adjusted. In one arrangement, length adjusting device 70 is a spring loaded push button cord adjustment device.

In this arrangement, as more draw string 70 is pulled, the length of the sock member 54 is shortened. Once the desired length of the draw string 70 is established, the length adjustment device 72 is engaged and the length of the sock member 54 is set. Use of a draw string 70 helps to provide added rigidity to the sock member 54 when used as a sling as the draw string 70 tends to take up much of the stretch of the sock member 54.

Shoulder Pad: In one arrangement, to provide additional comfort for the user, a shoulder pad 74 is added to the exterior surface of the sock member 54. Shoulder pad 74 is any form of a compressible device, such as for example a piece of compressible material, a piece of foam, a piece of rubber, or any other compressible material, added to the sock member 54. In one arrangement, shoulder pad 74 is formed of or includes non-slip features or material such as plastic or rubber pads. The use of non-slip material or non-slip features helps to prevent the sling from accidently sliding off of the user's shoulder when in use.

Zipper Arrangement: In another arrangement, sock member 54 includes a zipper 76 that extends a length of the sock member 54 between rearward end 78 to forward end 80. In this arrangement, the zipper 76 is opened and the gun 12 is inserted through the opening formed by the zipper 76. Once the gun 12 is inside the sock member 54 the zipper 76 is again closed thereby holding the gun 12 within the sock member 54.

Note the term sling swivel as used herein is not meant to be limited to any one form of a device. Instead, the term sling swivel is merely intended to mean any mechanical device that is used to couple two devices together. In this way, the term sling swivel is broad and non-limiting.

From the above discussion, it will be appreciated that the sock and sling system presented improves upon the state of the art. That is, the sock and sling system presented: eliminates the redundancies of carrying both a sling and a gun sock; improves a user's hunting or shooting experience; eliminates unnecessary extra pieces of equipment; complies with casing laws; is easy to use; is convenient to use; is safe to use; is adjustable; has a simple design; saves money; is inexpensive; is comfortable to use; has an intuitive design; has a minimal number of parts; is durable; provides a long and useful life; provides dual functionality of casing and carrying a gun, among countless other advantages and improvements.

It will be appreciated by those skilled in the art that other various modifications could be made to the device without parting from the spirit and scope of this invention. All such modifications and changes fall within the scope of the claims and are intended to be covered thereby.

What is claimed:

1. A sock and sling system, comprising:
a sock member having an open interior;
a first sling swivel having a loop with an opening;
a second sling swivel having a loop with an opening;
wherein the sock member is connected through the opening of the loop of the first swivel at a first end and the sock member connected through the opening of the loop of a second swivel at the second end.

2. The sock and sling system of claim 1 further comprising a strap connected to the sock member and extending a length of the sock member.

3. The sock and sling system of claim 1 wherein the first end of the sock member has an opening that includes a drawstring that opens and closes the opening.

4. The sock and sling system of claim 1 further comprising a length adjusting drawstring that extends a length of the sock member between the first end and the second end so as to adjust the length of the sock member when used as a sling.

5. The sock and sling system of claim 1 further comprising an exterior surface of the sock member having a shoulder pad.

6. The sock and sling system of claim 1 wherein the first sling swivel or the second sling swivel is a dual release sling swivel.

7. The sock and sling system of claim 1 further comprising a strap connected to the sock member at a plurality of places such that the length of the sock member can be adjusted when used as a sling.

8. The system of claim 1 wherein the sock member has a zipper.

9. The system of claim 1 wherein the first and the second sling swivels have a main body connected to each loop.

10. The system of claim 9 wherein an activation button extends outwardly from one side of the main body and has a rotatable collar rotatable between a locked and unlocked position.

11. The system of claim 9 wherein each main body has a locking member removably coupled to a mounting rod.

12. A method of using a sock and sling system, the steps comprising:
providing a sock member extending a length from a first end to a second end, the sock member having an open interior;
storing a gun in the open interior of the sock member in a storage state;
removing the gun from the open interior of the sock member;
attaching the sock member to the gun through an opening of a first sling swivel loop and through an opening of a second sling swivel loop; and
using the sock member as an adjustable sling once attached to the gun by the first sling swivel and the second sling swivel.

13. The method of using a sock and sling system of claim 12 further comprising the step of providing a strap connected to the sock member that extends a length of the sock member.

14. The method of using a sock and sling system of claim 12 wherein the first end of the sock member has an opening that includes a drawstring that opens and closes the opening.

15. The method of using a sock and sling system of claim 12 further comprising the step of providing a length adjusting drawstring that extends a length of the sock member between the first end and the second end; and adjusting the length of the sock member by adjusting the length adjusting drawstring when the sock member is used as a sling.

16. The method of using a sock and sling system of claim 12 wherein an exterior surface of the sock member has a shoulder pad.

17. The method of using a sock and sling system of claim 12 wherein the first sling swivel or the second sling swivel is a dual release sling swivel.

18. The method of using a sock and sling system of claim 12 further comprising the step of providing a strap connected to the sock member at a plurality of places such that the length of the sock member can be adjusted when used as the sling.

* * * * *